US009903171B2

(12) United States Patent
Linetskiy

(10) Patent No.: US 9,903,171 B2
(45) Date of Patent: Feb. 27, 2018

(54) METHOD FOR DEVELOPING OIL AND GAS FIELDS USING HIGH-POWER LASER RADIATION FOR MORE COMPLETE OIL AND GAS EXTRACTION

(71) Applicant: Alexander Petrovich Linetskiy, St. Petersburg (RU)

(72) Inventor: Alexander Petrovich Linetskiy, St. Petersburg (RU)

( * ) Notice: Subject to any disclaimer, the term of this patent is extended or adjusted under 35 U.S.C. 154(b) by 0 days.

(21) Appl. No.: 15/621,568

(22) Filed: Jun. 13, 2017

(65) Prior Publication Data

US 2017/0275960 A1 Sep. 28, 2017

Related U.S. Application Data

(63) Continuation-in-part of application No. 14/358,679, filed as application No. PCT/RU2013/000768 on Sep. 4, 2013, now Pat. No. 9,677,339.

(30) Foreign Application Priority Data

Sep. 4, 2012 (RU) ..... 2012137540

(51) Int. Cl.
*E21B 29/00* (2006.01)
*E21B 43/11* (2006.01)
*E21B 7/00* (2006.01)

(52) U.S. Cl.
CPC ..... *E21B 29/002* (2013.01); *E21B 43/11* (2013.01); *E21B 7/00* (2013.01)

(58) Field of Classification Search
CPC ..... E21B 7/15; E21B 7/30; E21B 41/0035; E21B 43/285; E21B 43/2401; B23K 26/382
See application file for complete search history.

(56) References Cited

U.S. PATENT DOCUMENTS

| | | | |
|---|---|---|---|
| 4,090,572 | A | 5/1978 | Welch |
| 4,113,036 | A | 9/1978 | Stout |
| 5,107,936 | A | 4/1992 | Foppe |
| 6,851,488 | B2 | 2/2005 | Batarseh |
| 6,880,646 | B2 | 4/2005 | Batarseh |
| 6,888,097 | B2 | 5/2005 | Batarseh |
| 7,334,637 | B2 | 2/2008 | Smith, Jr. |
| 9,217,291 | B2 | 12/2015 | Batarseh |
| 2007/0056505 | A1 | 3/2007 | Wehrhan et al. |

(Continued)

*Primary Examiner* — Shane Bomar
(74) *Attorney, Agent, or Firm* — St. Onge Steward Johnston & Reens, LLC

(57) ABSTRACT

A system for extracting oil and gas includes at least one drilling rod having an elongated body and a working head positioned at the distal end of the elongated body, wherein the working head has a proximal end and a distal end, a first mechanical drilling device positioned at the distal end of the working head, a second mechanical drilling device position at the proximal end of the working head, a central laser emitter positioned at the distal end of the working head, at least one lateral emitter positioned on a side wall of the working head between the distal end and the proximal end, a fiber optic cable positioned within a lumen of the elongated body and coupled to the central laser emitter and the at least one lateral emitter, and a laser source coupled to and supplying a laser beam to the fiber optic cable.

23 Claims, 3 Drawing Sheets

(56) References Cited

U.S. PATENT DOCUMENTS

| | | | | |
|---|---|---|---|---|
| 2008/0245568 | A1* | 10/2008 | Jeffryes | E21B 7/06 175/16 |
| 2009/0126235 | A1* | 5/2009 | Kobayashi | E21B 7/00 37/195 |
| 2011/0220409 | A1 | 9/2011 | Foppe | |
| 2012/0074110 | A1* | 3/2012 | Zediker | B08B 7/0042 219/121.72 |
| 2014/0054087 | A1 | 2/2014 | Wang et al. | |
| 2014/0090846 | A1 | 4/2014 | Deutch et al. | |
| 2014/0299375 | A1 | 10/2014 | Bozso et al. | |
| 2014/0346157 | A1 | 11/2014 | Bozso et al. | |
| 2016/0153240 | A1 | 6/2016 | Braga et al. | |

* cited by examiner

METHOD FOR DEVELOPING OIL AND GAS FIELDS USING HIGH-POWER LASER RADIATION FOR MORE COMPLETE OIL AND GAS EXTRACTION

FIELD OF THE INVENTION

The subject matter generally relates to mining industry and may be used to develop fields and for the most complete extraction of oil having varying viscosity and gas, as well as other mineral resources, from oil and gas fields, shale and other layers and geological formations.

BACKGROUND OF THE INVENTION

A method is known for increasing oil and other mineral liquids rate of extraction from oil layers of the earth or sea (RU 1838594 A3). As a device for transmitting energy for subsequent impact on oil layer electrodes located in two neighboring wells and mercury, preliminarily placed within wells up to the level of oil layer bedding, are used. Then, in the oil layer, the vibration is created via vibrators with the frequency that is the closest to the resonating frequency of the layer. For this purpose, the mercury vibration is created via those inserted vibrators and the electric stimulation of the vibration process is simultaneously performed via voltage alternating current applied to the electrodes in the neighbor wells. Those resonant vibrations in the said field spread outside and provide oil extraction from the field. Energy of vibrations also produces heat in the field, which is released due to the friction between the field and oil, located within, thus creating the increase in pressure that results from the evaporation of some part of oil and water.

However, the method described above has the following disadvantages:

- use of mercury as liquid electrodes is very dangerous due to unhealthy exhalations and ecological pollution of the environment and the ground water;
- large areas of contact between vibrating surfaces and oil layer are needed to spread resonant vibrations outside the field and extracting oil, power consumption is large, and the method implementation is costly;
- the efficiency of oil extraction from the field via this method is insufficient.

A method is also known for increasing extraction of oil, gas and other mineral resources from the earth interior, formations drilling and control (RU 2104393). According to this method, at the specified well sites, the productive layers are drilled via cutting or perforating the material of wells casing columns with a high-power laser beam with subsequent evaporation, via those slots, of solid and liquid phases of substances, included into structure of layers and the mountain rock comprising the layers, with optical fiber cables having operating heads on their tips emitting light energy to be used as a device to transfer energy, the optical fibers (light guides) of the optical fiber cables connected to the high-power lasers on the surface to create areas within the layers having the specified high temperature with the high pore pressure to improve oil and gas extraction rate, and move those areas, within the in-situ spaces, by moving the emitting tips of optical fiber cables with the operating heads on within the wells, wherein the process of layer treatment via high-power laser beams at the fields is repeated multiple time with necessary time intervals and with simultaneous emission by several sectors mutually shifted at the specified angle to each other, and with divergence of beams in each sector onto the specified angle, thus conducting non-contact and remote control of temperature values and pressures created within layers, as well as sizes and forms of cavities formed within layers and rocks and their linkage, to get the information relating to the composition of evaporating substances within the layers and rocks, to be performed simultaneously, via special optical fibers.

However, the above method has following disadvantages:

- it is impossible to implement complex development of fields and to use high-power laser beams not only for the in-situ spaces treatment to increase oil and gas extraction, but also to drill the wells from the surface to uncover oil and gas, shale, coal and other layers with mineral resources;
- low efficiency and capacity of treatment of the in-situ spaces in the formation layers via the high-power laser beams and increase of pore pressures and temperatures through perforation holes and slots in metal pipes casing that reinforce the production wells due to small areas of in-situ spaces processed with the beam;
- it is impossible to substantially increase the diameters of wells that are reinforced with pipes within the in-situ spaces in order to increase areas of inflows and to improve filtration from oil and gas layers into wells;
- increased oil and gas production costs, together with the time consumed to put wells into operation for production, due to the need to involve other expedient methods for bore-holing of wells and cleaning of bottomhole zones of layers from deeply penetrated drilling and cement solutions with formation of impermeable mud cakes in layers, resulting from the wells drilling with the use of the casing pipes.

SUMMARY OF THE INVENTION

The objective of the invention is to achieve the most complete and efficient extraction of all types of oil, including high-viscosity oil and bitumens, shale oil from kerogens, gas condensates and shale gas from oil and gas, shale and other layers, under most common conditions, via high-power laser beams. Use of the method of the present invention results in a substantial profit derived from the most complete extraction of oil and gas out of layers, thus substantially improving ecology in territories having the fields. The proposed method provides the most technologically efficient and ecologically friendly, almost complete extraction of oil and gas reserves on-shore and off-shore, including those considered difficult and non-recoverable, and, most importantly, allows for drilling of wells in oil and gas layers from earth and sea surface without the need for drilling liquids and reinforcement of well walls with casing pipes, and allows for both continuous and major repairs of wells without the traditional reinforcement of wells walls with casing pipes and cementing external casing in formation layers and rock material. The method of the present invention allows for cleaning of production wells and field equipment used therein from asphalt, tar and paraffin deposits using a high-power laser beam. The proposed method, when used for developing shale layers and for extracting shale gas, allows for opening of maximum number of closed cavities containing gas and achieving the highest level of its extraction with optimal decrease of separation distance between long drill-holes with small diameters that are drilled from neighboring production wells towards each other within in-situ spaces with specified movement of axis of the drill-holes under specific conditions for various layers in order to prevent passing over closed cavities filled with shale gas. This method also allows for destruction of subsurface waste disposal sites and mortuaries containing harmful radioactive and chemical substances via evaporating them under the ground, and also provides for melting of various metals from ore bodies, lens and metal veins into subsurface workings. Due to intensive extraction of oil and gas from fields, time needed to develop the field is reduced in order to obtain additional profit and eliminated any ecological issues throughout neighboring territories around the field.

The objectives of the invention are achieved by implementing a method for developing oil and gas fields using high-power laser radiation for more complete oil and gas extraction, comprising the steps of opening up producing formations in predetermined regions of the wellbores by cutting or perforating material of the wellbore casing strings using high-power laser radiation with subsequent evaporation of solid and liquid phases of substances contained in the formations and in the matrix rock through these openings, wherein the optical fiber cables with light energy-emitting working heads on the ends thereof are used as energy transmitting devices, high-power lasers positioned at the surface are coupled to the optical fibers (light-emitting diodes) of the optical fiber cables and regions with a predetermined high temperature and a high pore pressure are generated in the formations in order to increase the degree of extraction of oil and gas, wherein the process of treating the field formations with high-power laser radiation is repeated multiple times with the necessary time intervals therebetween, wherein a plurality of sectors which are mutually offset from one another by a certain angle are irradiated simultaneously, the beams of each sector diverging at a given angle, wherein non-contact and remote control of temperatures, pressures, sizes and shapes of cavities created in the formation layers and their linkage is carried out simultaneously and information about content of evaporated material of the formation layers is being collected, wherein laser equipment is positioned at a predetermined depth in preexisting wells having reinforced walls with casing columns comprising pipes by using pipes with attached pumps or flexible pipes with coiled-tubing units, a plurality openings are drilled in the wellbore walls at predetermined locations via the laser equipment, wherein the plurality of openings comprise elongated drill-holes having a diameter in a range from less than about 20 mm to more than about 40 mm that are formed at high speed by evaporation and high temperature fracture of formation layers and rock material by high-power laser radiation emitted from the light energy-emitting working heads positioned at tips of the drill crowns, wherein the openings are drilled in the neighboring wells towards each other until they cross each other in formation layers and formation rock material, wherein flexible composite drilling rods are repositioned during the drilling process at a predetermined angle of about 0 degrees to at least 180 degrees, wherein a direction of drilling and a repositioning angle of the openings are controlled by a direction of laser radiation beams emitted from the optical fibers, wherein material drilled out of the elongated small-diameter openings is evaporated by the high-power laser radiation, wherein wells are drilled at new formation development fields by mechanical-laser drilling, wherein the optical fiber cables with the light energy-emitting working heads coupled to the high-power lasers positioned at the surface are in internal lumens of mechanic drilling equipment having hollow-type actuating rods and crowns, wherein rock formation material is fractured by the high-power laser radiation emitted from the working heads in order to achieve a desired diameter of the well by treating them with high-temperature laser radiation emitted from the working heads positioned at tips of drill crowns to fracture and evaporate the rock material during the drilling process, wherein secondary laterally positioned working heads are used to simultaneously deposit a reinforcement layer on the well walls by using a high-power laser radiation, wherein the reinforcement layer is made of mixtures of material remaining after evaporation of the material drilled out of the openings and substances and materials prepared at the surface and supplied into the wells, or, in cases of weakened areas or carbonate rocks having cracks and cavities formed therein, the secondary laterally positioned working heads are used to simultaneously deposit one or more reinforcement layers to the well walls, wherein the reinforcement layers are formed from the material drilled out of the openings by extracting it via compressed air from the bottom-holes towards ring deposit welding/burn-off devices equipped with high-power laser radiation emitters, and mixtures of quartz sand with necessary substances and materials supplied to the wells from the surface to be melted on walls of wells to improve their quality and toughness, wherein the material drilled out of the openings is completely evaporated and mixtures with necessary ingredients prepared at the surface are supplied to the wells and are deposited on the well walls via ring deposit welding or burning-off devices equipped with secondary laterally positioned working heads having high-power laser radiation emitters located at specified distance from working heads centrally positioned at the tips of the crowns of the drilling tools, wherein the secondary laterally positioned working heads are moved radially and rotationally separately or together with hollow-type actuating rods, wherein, after the drilling of wells to a desired depth is completed, the well walls are polished by removing the artificially created reinforcement layers of the well walls and creating smooth wall surfaces, and creating consistent diameters along the entire length of the wells, wherein well repairs are carried out by cleaning the well walls, pipes with pumps or other field equipment via tubing pipes and other field equipment from asphalt, tar and paraffin deposits by melting and evaporating them with high-power laser radiation while repeatedly moving multi-sided laser radiation emitters along the pipes or wells in a downward and then upward direction, wherein at fields that were opened by drilling wells in oil and gas and other layers via the laser-mechanical drilling diameters of vertical, angular or horizontal production wells are gradually increased by laser-mechanical drilling equipment having expandable well wideners, wherein the artificial layers made out of mixtures of well material and deposited on the well walls during the drilling process to reinforce the walls are removed to increase areas of oil and gas inflow from the formation layers into the wells, wherein diameters of production wells are repeatedly increased and multiple layers of specified thickness having asphalt, tar and paraffin deposits accumulated therein during the field development are removed from the well walls to improve filtration of oil and gas from the formation layers into the wells, wherein diameters of the wells are increased to maximum sizes possible under particular formation layer conditions and capabilities of the laser-mechanical drilling equipment, wherein within the oil and gas and shale layers, in particular, within layers having low permeability and porosity, after diameters of production wells are increased to their maximum, elongated drill-holes having small diameters are drilled in well walls by the high-power laser radiation equipment, to increase areas of inflow of oil and gas into the wells and to increase extraction from the formation, wherein, during treatment of formations having multiple oil and gas layers, diameters of production wells are gradually increased based on power, outstretch and falling within one or more layers being treated, and elongated drill-holes with small diameters are drilled therein, while neighboring formation layers located above or below the layer being treated and not having drilled wells and drill-holes are under-holed or over-holed to cause shifts of formation rock material between neighboring layers and within layers, to change crack systems within the rock material and to change stressed-deformed state thereof, to form oil and gas cross-flow channels between the formation layers and the drilled production wells in the neighboring layers that are being treated to speed up treatment of all layers within the formation with significantly lower costs and time consumed, wherein, in the presence of high-viscosity oil at the fields, a temperature and a pressure within the layers are increased, and a viscosity of oil is decreased by applying high-power laser radiation to spaces between the layers through production wells and elongated drill-holes having small diameters by inserting a plurality of optical fiber cables therein, wherein the production wells and the elongated drill-holes having small diameters drilled in the well are positioned at a specific distance from each other based at least in part on power, outstretch and falling of the layers, and wherein the number of the production wells and the drill-holes drilled therein is increased and a distance between them is decreased to achieve and maintain a target level of extraction of oil and gas from the formation field.

The method is implemented as follows. At the fields that are being treated and already have wells drilled therein, and have their walls fixed with casing columns of pipes, and, especially, within layers with low permeability, the existing net of vertical, inclined and horizontal wells is optimized by drilling additional production wells at a predetermined distance from each other. High-power laser units are set within some or all of the neighboring production wells at a specified depth via pipes with pumps connected to the laser units via screw type connectors. The lasers are used to drill long drill-holes with small diameters, to be optimized by power, outstretch and falling of the formation layers, via optical fiber and electrical cables connected to high-power lasers and alternating-current sources positioned on the surface, and a plurality of openings of desired dimensions and shapes are cut in the well walls via the lasers based on locations determined by suitable computer software. Then, a plurality of elongated drill holes are drilled from said plurality of openings at high speed via evaporation and high-temperature fracturing of the pipe materials, formation rock material and the layer materials via the high-power laser beams delivered by light energy emitters positioned on tips of drill crowns. The plurality of elongated drill-holes having small diameters are drilled from adjacent production wells towards each other until they cross with each other within space between the formation layers, optimized by power, outstretch and falling of the layers. The fact that axes of the drill-holes diverge from the axis of crossing of the bottom-holes within in-situ spaces in a range from about several dozens centimeters to several meters has no impact on efficiency of treatment of oil and gas layers and other layers with the high-power laser beams and has not impact on inflow of oil and gas into the wells. Length of the drill-holes having small diameters, which is typically in a range from less than about 20 mm to more than about 40 mm, may be increased when the drill-holes are drilled from adjacent wells to a range from less than about 20 m to more than about 200 m, depending on a distance between the wells at the formation field. A plurality of elongated drill-holes with small diameters may also be drilled in a single well separated from other wells, which results in increased extraction of oil and gas from the formation layers. During drilling, flexible composite short drilling rods are turned at a specified angle from about 0 degrees to more than about 180 degrees, and a direction of the drilling of the elongated drill-holes with small diameters is monitored via marked optic fibers (light guides) and via laser beams transmitted through said optic fibers to specify the direction of drilling and angles of their rotation in the formation layers and rock material, as well as to determine components of rock and layer material and temperature and pressure values within in-situ spaces. Data control and analysis are performed via suitable computer devices located at the surface, which are also used for mathematic modeling in 3D format of the processes within the formation layers and for real-time optimization of positioning and arrangement of the wells and elongated drill-holes with small diameters within in-situ spaces, especially with layers having low permeability and porosity, to achieve maximum extraction rate of oil and gas from the formation layers.

The laser units positioned at the surface include one or more control elements, depending on the number of wells at the formation field, provided with sets of flexible composite short drilling rods having drill crowns, laser energy emitters for drilling elongated drill-holes with small diameters, optical fiber and electrical cables, and powerful computers. The control elements may be stationary or movable, may be installed on special all-terrain vehicles, and may be equipped with independent sources of electric power, and/or be capable of being connected to existing electric power lines.

The material drilled out of the elongated drill-holes with small diameters is completely evaporated via the high-power laser beams, thereby significantly increasing the speed of drilling of the drill-holes, and the high-power light energy emitters positioned at the tips of drill crowns are protected from rock particles and from penetration of water, oil and other substances by lenses made with high strength transparent materials, such as, for example, sapphire lenses made of artificial crystals, and the lenses are used to change the focus of the laser beams to increase or reduce their influence based on strength of the rock and layer materials or the mode of influencing them during the drilling. In order to increase inflow of oil and gas from layers into the wells, and to achieve the most efficient extraction thereof from the formation layers, the drilling of the long drill-holes with small diameters, which is optimized by power, outstretch and falling of oil and gas layers, from neighboring vertical, inclined or horizontal production wells is carried out under any geological conditions, and it is always considered to be the one of the most efficient operations of the method proposed to provide an increased inflow of oil and gas. Even when layers with low permeability and porosity are present in the formation, it is always possible to reach a significant increase of oil and gas inflow into the production wells by reducing the distance between the long drill-holes with small diameters, and by increasing their diameters and the number of such drill-holes up to optimal values, which are determined based on practical results of treating such layers and by mathematic modeling via computers in a real-time mode. If the field situation is complicated due to the presence of high-viscosity oil, bitumens or shale oil from kerogens in the layers, a temperature and pressure in the layers may be increased and the viscosity of oil and bitumens may be decreased, and the process of transformation of kerogens into shale oil is facilitated by raising the temperature, and the mining conditions are improved by using high-power laser beams in the in-situ spaces via the wells and the long drill-holes with small diameters by inserting a plurality of optical fiber cables with light emitters into the wells and long drill-holes. The production wells and long drill-holes with small diameters drilled from the wells are located at a specified distance from each other, optimized by power, outstretch and falling of the formation layers. When necessary, high-temperature treating of the layers with high-power laser beams from the wells and drill-holes is repeated multiple times to achieve a desired level of oil and gas extraction from the fields.

When the formation field contains oil with high content of asphalt, tar and paraffin material, the method of the present invention improves consistency and reliability of the production wells in extracting oil and gas from the formation layers during development of the fields. In the upper part of wells, sediments appear all year round and increase under low temperatures on the surface, sometimes causing complete clogging of the pipes. In such cases, especially during the winter season, it is necessary to clean pipes and other field equipment and the well walls from the asphalt, tar and paraffin deposits by melting and evaporating the deposits via high-power laser beams by repeatedly moving the optical fiber cables with light energy emitters up and down the pipes and wells by using a suitable mechanism, such as a lift with a reel suitable for this type of cable. Cleaning procedures, such as cleaning sediments from pipes, wells and other field equipment, are performed when necessary and are frequently carried out together with the drilling of long drill-holes with small diameters or together with increasing the temperature and pressure within layers in order to reduce loss of time for oil and gas extraction therefrom.

The above-mentioned procedures can also be utilized at new undeveloped fields. In such cases, the development procedures will be different from the development procedures used in the previously treated fields because there are new opportunities when production wells are drilled from the surface to the depth oil and gas layers bedding and other layers, and there are more efficient procedures for developing layers, with no need for use of complex drilling solutions for drilling the wells, no need for reinforcement of the well using casing pipes with subsequent cementing of casing annulus. Typically, complex drilling solutions made with special clays and compositions, as well as solutions including cement materials, penetrate deeply into cracks and pores of bottom-hole areas of layers and form impermeable mud cakes, thus completely preventing an inflow of oil and gas into the drilled production wells. In order to restore this inflow and to restore the filtration and permeability of the layers back to their natural state, additional expensive and time-consuming operations have to be carried out to clean near-mine zones of layers from mud cakes and to begin extraction of oil and gas. Such method does not always lead to desired results, and the filtration capacity within those layers remains below the values that occur under natural conditions.

The method according to the present invention avoids the significant disadvantages described above. Wells are drilled at the new undeveloped fields by using laser-mechanical drilling tools, wherein light energy emitters and optical fiber cables that transmit light energy from high-power lasers positioned at the surface are placed within internal openings of the mechanical drilling tools with hollow-type actuating rods and crowns. This equipment is used to completely break down the rock material to create wells with desired diameters by treating the wells with high-temperature high-power laser beams emitted from the ends of drill crowns, which break down and evaporate the rock material during the drilling process. At the same time, the high-power laser beams emitted from lateral or other emitters are used to deposit a layer of mixtures, consisting of premade substances delivered from the surface and portion of material drilled out of the wells, of the well wall in order to reinforce the walls, or, where suitable rock material is present, the inner surfaces of the well wall are melted in order to reinforce them. During drilling of the wells in very dense rock formations, such as basalts, the rock material drilled out of the bottom-holes is fully evaporated by the high-power laser beams, without the need for reinforcement of the well walls. This allows for quick and efficient drilling of wells within dense rock formations at wide range of depths within minimal consumption of time and resources. The use of the laser-mechanical drilling tools in accordance with the present invention allows for drilling of significantly larger number of production wells at any desired depth within shorter time periods, thus significantly improving the well drilling efficiency, as well as significantly reducing distances between the production wells at oil and gas, shale, coal and other production fields, to allow for full treatment of the fields with minimum waste of mineral resources and under a greater variety of conditions. The method of the present invention also allows for drilling of very deep wells drilling towards geothermal energy sources within Earth's crust.

Maximum outgoing power of the laser beams in accordance with the invention can achieve large values, such as dozens of megawatt and more, that is capable of destroying and evaporating any surrounding material. There many types of known lasers that can be used with the invention, as well as any type of lasers that may be developed in the future. The method of the invention may utilize multi-wire cables, suitable for use under extreme underground drilling conditions, that have a plurality of optical fibers (light guides). Such optical fiber cables are very strong and durable, have additional protective covers and steel shield, and light guides that are coated with polymer layers that protects them from mechanical damage. The inner structure of such cables is filled with a gel-like material that protects them against penetration by air and water. Optical fibers are suspended within the gel-like material that has anti-freeze properties and can withstand temperatures below −40° C. Steel cables positioned within the same covering with the optical fiber cables are used as strengthening elements. All light beams reach the ends of the optical fiber cables simultaneously. During drilling of the wells and drill-holes, the reflected laser beams are transmitted through separate optical fibers back to computers positioned at the surface to process information about evaporated mountain rocks and layers, ground waters, temperatures and pressures within layers, oil-and-gas properties and various other parameters and characteristics of the mountain formations. The high-power lasers positioned at the surface are connected to a power line and generate light beams that are transmitted along the light guides of optical fiber cables towards the target sites within the wells without energy losses. Known optical fiber cables have transmission bands with power of dozens of gigahertz, thus allowing transmission of laser beams to a distance of dozens of kilometers. Use of such cables in accordance with the invention allows for increasing a temperature of mountain rocks and layers temperature with high-power laser beams during the drilling of wells and long drill-holes to dozens of thousands of degrees Celsius, up to their plasma phase, and evaporating mountain rocks and layers, and solid and liquid substances and increasing pressure within formation to desired values to achieve most complete and efficient extraction of oil and gas from the fields.

After the drilling of wells to a desired depth, the well walls, covered by a reinforcement layer created mainly from melted artificially created mixture deposited on the walls, are polished by additional melting of wall layers to create smooth surfaces and consistent diameters along the entire length of wells. Whenever necessary, the above-discussed method for creating the wells may be used to carry out continuous and major repairs of the wells. The procedures aimed at maintaining the operation of wells are carried out beyond oil and gas, shale and other layers of mineral resources. At the sites where the production wells were initially drilled through oil and gas layers and the well walls are reinforced with melted layers, the extraction of oil and gas is initiated by cutting off the reinforcement layers created by depositing melted mixtures of drilled out material and artificial substances injected into the wells from the surface or melting the layers of suitable rock material. The reinforcement layers are cut stepwise in order to increase, by power, outstretch and falling, the diameters of the vertical, inclined or horizontal production wells to a desired value via the laser-mechanical drilling tools of the present invention, which include expandable devices for widening the wells that are hollow and accommodate optical fiber cables and emitters of high-power laser energy for high-temperature destruction and evaporation of rock material and layers substances contained therein, thus significantly increasing areas of oil and gas inflow into the wells. Then, during the operation of the production wells, their diameters may be increased repeatedly as necessary by cutting off subsequent layers of desired thickness from the well walls, together with asphalt, tar and paraffin deposits accumulated on the walls and rock particles stuck to them, thus improving filtration of oil and gas into the wells. The well diameters are increased to maximum sizes suitable under particular conditions of layers bedding, taking into account the capacities of the laser-mechanical drilling equipment, the design of which allows moving them within the wells in a closed configuration and gradually opening them to a desired degree to cut multiple layers off the well walls to increase diameters of the production wells. Once the maximum possible diameters of the production wells are achieved, the laser beams are used to drill long drill-holes with small diameters in order to increase inflow of oil and gas into the production wells, resulting from enlarged filtration areas within the formation layers. Areas of oil and gas inflow from the formation layers into the wells are maximized by increasing lengths and diameters of the drill-holes and decreasing the distance between the drill-holes. As a result, it is possible to extract oil and gas reserves from spaces beyond the perimeter of deposits at the fields, which are typically considered to be non-recoverable, and even from non-reservoir rocks and layers with very low permeability and porosity due to cross-flows and vast areas of contact with reservoir-layers with good permeability, due to production wells with big diameters drilled throughout the layers and resulting from maximizing of the diameters by cutting multiple layers off the well walls, especially within inclined and horizontal wells, which is particularly desirable during treatment of rock formation having many layers with varying thickness and complex geological conditions, such as thrust faults, hade faults, breaks in rock layer continuity and other similar issues. This sequence of operations during the development of fields results in significant increase of subsurface management efficiency and leads to the most efficient oil and gas extraction.

When the rock formations contain multiple oil and gas layers, the steps of increasing diameters of the production wells, optimized by power, outstretch and falling of the layers, and drilling of multiple drill-holes with small diameters in a single layer or several adjacent layers within the formation lead to under-holing or over-holing of adjacent closely-spaced layers positioned above or below the ones being treated, which in turn leads to changes in the stress-deformed state of the mountain rock material between the adjacent layers and within layers, movement of rocks and layers, formation of additional cracks systems, and multiple oil and gas cross-flows from the adjacent layers, which do not yet have drilled production wells or long drill-holes with small diameters. This creates cross-flows of oil and gas through the systems of new cracks and channels into the drilled wells in the adjacent layers being developed. This allows for extraction of oil and gas from the adjacent layers in the formation suits without the need of drilling production wells therein. In order to improve the inflow from such adjacent layer located below or above the layers being developed after some time, additional long drill-holes with small diameters may be drilled from the production wells into the adjacent layers to improve the development efficiency of the entire field comprising many layers by utilizing mutual influence of layers while performing under-holing and over-holing procedures, thus allowing treatment of layers with low permeability and porosity.

After such treatment of adjacent layers within the formation suits, a pressure exerted upon the under-holed or over-holed adjacent formation layers by the overlying rock mass is decreased due to the significant displacement of rocks and layers. This leads to increased permeability and increased rate of opening of cracks and pores in layers of oil and gas, shale oil, and coal, together with significant increase in filtration of oil and gas into the production wells, as well as formation of new draining and filtration macro-systems, allowing for extraction of all moving oil and gas from suits of layers, in particular during the final stages of field development when maximum displacement of layers and mountain rock containing them takes place. The method of the present invention allows for significant reduction of time required for treatment of all the layers in suits, thus improving efficiency of oil and gas extraction and significantly reducing expenses, while achieving significant economic benefit from developing the suits that include many oil and gas layers independently of geological conditions regarding their formation and tectonic issues of the layers' bedding arising therewith. According to the experimental results and utilizing computer modeling in 3D format, optimal arrangement of production wells and long drill-holes with small diameters in suites having many oil and gas layers is determined, as well as the order and the sequence of treatment of layers within the shortest period of time with maximum efficiency of oil and gas extraction and minimum expenses.

The present invention includes system for extracting oil and gas, including at least one drilling rod having an elongated body and a working head positioned at the distal end of the elongated body, wherein the working head has a proximal end and a distal end, a first mechanical drilling device positioned at the distal end of the working head, a second mechanical drilling device position at the proximal end of the working head, a central laser emitter positioned at the distal end of the working head, at least one lateral emitter positioned on a side wall of the working head between the distal end and the proximal end, a fiber optic cable positioned within a lumen of the elongated body and coupled to the central laser emitter and the at least one lateral emitter, and a laser source coupled to and supplying a laser beam to the fiber optic cable.

In some embodiments, the system also includes a controller coupled to at least one of the central emitter and the at least one lateral emitter, wherein the controller controls at least one characteristic of the laser beam. In certain of these embodiments, the at least one characteristic includes at least one of laser beam direction, laser beam intensity, time duration of laser beam emission, laser beam temperature, laser beam diameter, laser beam length, and laser beam focus.

In some cases, the system also includes at least one lens positioned over the central emitter and the at least one lateral emitter.

In certain embodiments, the system further includes an additional central emitter positioned at the proximal end of the working head adjacent the second mechanical drilling device.

In some embodiments, the system also includes a motor coupled to the working head, wherein the motor actuates a rotational movement of the working head.

In certain embodiments, the system further includes an expanding member coupled to the working head adjacent its distal end, wherein the expanding member comprises two or more drilling crowns coupled thereto and an actuator that expands the expanding member such that the drilling crowns come into contact with surrounding rock material. In some of these embodiments, the expanding member performs a forward movement to displace surrounding rock material as the drilling device moves into a drill-hole. In additional embodiments, an additional expanding member coupled to the working head adjacent its proximal end, wherein the additional expanding member comprises two or more drilling crowns coupled thereto and an actuator that expands the additional expanding member such that the drilling crowns come into contact with surrounding rock material, wherein the additional expanding member performs a backward movement to displace surrounding rock material as the drilling device is withdrawn from the drill-hole. In further embodiments, the drilling crowns of the expanding member and the additional expanding member perform a rotational movement to break down surrounding rock material.

In some cases, the system also includes at least one fixator positioned in the lumen of the elongated body, wherein the at least one fixator receives the at least one fiber optic cable to prevent it from coiling.

In certain embodiments, a fluid supply lumen is also positioned in the inner lumen of the elongated body and an outlet positioned at the distal end of the elongated body and coupled to the fluid supply lumen, wherein fluid is supplied through the fluid supply lumen and the outlet to cool down the surrounding rock material after it is impacted by the laser beam emitted from at least one of the central emitter and the at least one lateral emitter.

In additional embodiments, a steering mechanism is also provided coupled to the working head of the at least one drilling rod, wherein the steering mechanism changes a direction in which the working head travels.

A method of developing oil and gas fields is also provided, including the steps of inserting at least one drilling rod into an existing well, the at least one drilling rod having a working head with a distal end and a proximal end, forming at least one elongated drill-hole from said well into surrounding material by impacting rock material via a laser beam emitted from an emitter positioned at the distal end of the working head, and extending a length of the at least one elongated drill-hole by moving the at least one drilling rod further into the elongated drill-hole while continuing to impact the rock material via the laser beam.

In some embodiments, the method also includes a step of displacing the impacted rock material via a front drilling head positioned at the distal end of working head of the at least one drilling rod while moving the drilling rod into the elongated drill-hole. In certain of these embodiments, the method further includes a step of displacing surrounding rock material via a rear drilling head positioned at the proximal end of the at least one drilling rod while withdrawing the drilling rod from the elongated drill-hole.

In certain embodiments, the method includes a step of adjusting an angle between a longitudinal axis of the at least one elongated drill-hole and a longitudinal axis of the existing well by changing a direction of the laser beams emitted from the emitter positioned on the at least one drilling rod. In some of these embodiments, the direction of the laser beams emitted from the emitter is changed by articulating the distal end of the working head of the drilling rod.

In some cases, the emitter is extendable relative the distal end of the working head and the step of impacting rock material via the laser beam includes extending the emitter past the distal end of the working rod.

In certain embodiments, the method also includes a step of enlarging an inner diameter of the elongated drill-hole by displacing surrounding rock material via an expanding member coupled to the working head adjacent its distal end, wherein the expanding member comprises two or more drilling crowns coupled thereto and an actuator that expands the expanding member such that the drilling crowns come into contact with surrounding rock material and displace the rock as the at least one drilling rod is moved into the elongated drill-hole. In some of these embodiments, the method includes a step of adjusting an angle between a longitudinal axis of said at least one elongated drill-hole and a longitudinal axis of the well by changing a position of the drilling crowns of the expanding member. In additional embodiments, the method includes a step of displacing rock material in the elongated drill-hole via an additional expanding member coupled to the working head adjacent its proximal end, wherein the expanding member comprises two or more drilling crowns coupled thereto and an actuator that expands the expanding member such that the drilling crowns come into contact with surrounding rock material and displace the rock as the at least one drilling rod is withdrawn from the elongated drill-hole In some cases, the method also includes a step of removing fluid byproducts of gaseous hydrocarbons from the at least one elongated drill-hole via a fluid return lumen provided in the at least one drilling rod.

In certain embodiments, the method further includes a step of supplying oxygen to the at least one elongated drill-hole via a lumen of the at least one drilling rod to initiate burn out of at least one of gaseous hydrocarbon byproduct, gas and oil.

In additional embodiments, the method includes a step of forming at least one additional-drill hole via an additional drilling rod placed in an adjacent well such that the two drill-holes intersect each other.

The foregoing and other objects and advantages will appear from the description to follow. In the description reference is made to the accompanying drawing, which forms a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawing, like reference characters designate the same or similar parts throughout the several views.

BRIEF DESCRIPTION OF THE DRAWINGS

The invention is illustrated in the drawings, wherein.

DETAILED DESCRIPTION OF THE INVENTION

Figure 1A:
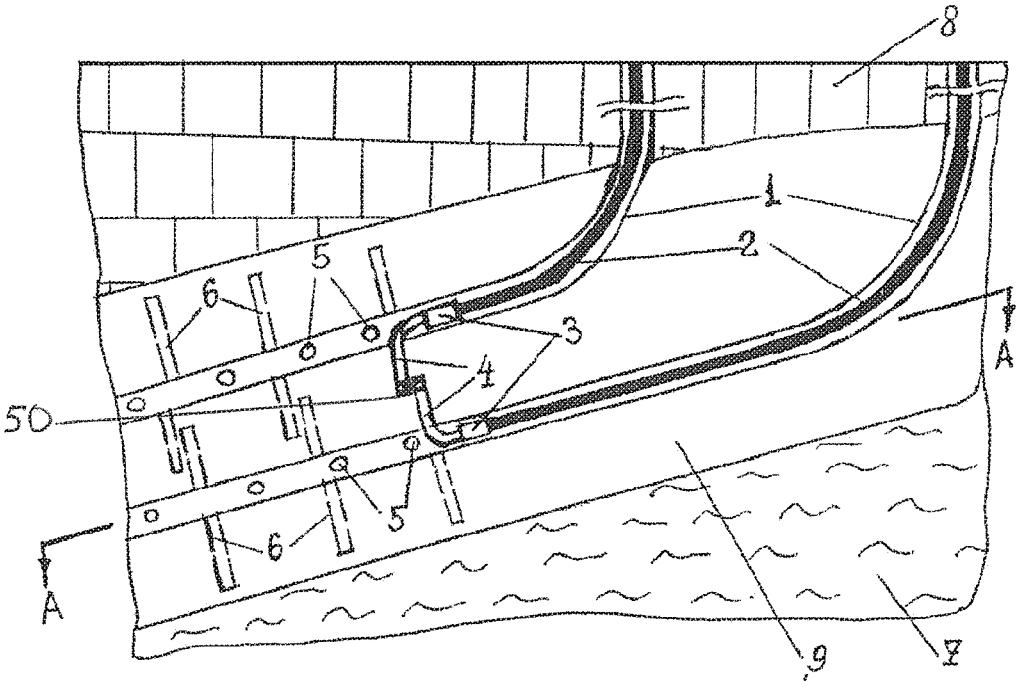
FIGS. 1A-1B, 2 and 3 illustrate the high-power laser beam system of the present invention and the implementation of the method of the present invention for developing fields and providing for the most complete extraction of oil and gas via high-power laser beam systems.
Figure 1B:
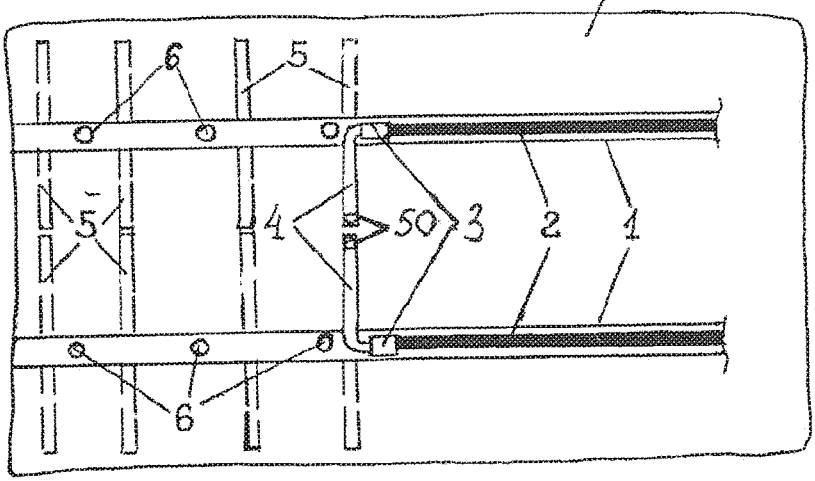

FIG. 1A shows the vertical cross-section of the rock mass, which illustrates one exemplary embodiment of the arrangement of inclined-horizontal production wells 1 within oil and gas layer 9 of large thickness with the laser system 3 positioned in the wells at a specified depth via hydraulic pipes 2 coupled to the system via gear mechanism. FIG. 1B illustrates a horizontal cross-sectional view along the line A-A of the well 1 and through the layer 9.

In the embodiment shown in these figures, the high-power laser equipment is used in the field being under treatment for extended period of time and having drilled production wells 1 with casing columns made of metal pipes placed in the well to reinforce well walls. The laser system 3 with flexible composite drilling rods 4 and crowns 20 having emitters of laser energy positioned at their ends is placed in the wells 1 and is connected via optical fiber cables to the high-power laser equipment positioned at the surface and to the alternating-current source via electrical cables, wherein the cables are positioned inside the pipes 2. Based on predetermined coordinates programmed into the laser system 3, a plurality of long drill-holes 5 and 6 with small diameters are drilled at high speed due to evaporation and destruction of layer material 9 at high temperatures, wherein the layer 9 is located between clay containing top layer 5 and bottom layer 7, which are impermeable to oil, gas and underground layer waters and which isolate the layer 9 from the rest of the mountain rock mass.

The high-power laser beams used in drilling are emitted from emitters of light energy positioned at distal ends of flexible composite drilling rods 4 with the crowns 15. The diameters of the long drill-holes 5 and 6 range from less than about 20 mm to more than 40 mm. The drill-holes 5 and 6 are drilled from adjacent production wells 1 towards each other until they intersect within the layer 9 by capacity (drill-holes 6) and by outstretch (drill-holes 5).

During the drilling, the drill-holes may be angled from their axes at the intersection points in the range from about few dozens of centimeters to several meters during their drilling towards each other, and this has no impact on efficiency of oil and gas inflow therefrom into the production wells because the areas of inflow of oil and gas from the layer into the long drill-holes are still in the range of many dozens and hundreds of meters. During the drilling of long drill-holes with small diameters, flexible composite drilling rods 4 having drilling crowns 50 positioned at their distal ends are rotated to a specified angle from about 0 degrees to about 180 degrees and more, and the direction of the drilling of the long drill-holes in controlled via laser beams transmitted through the dedicated optical fibers within the cables. Wherein a high accuracy of intersection between the long drill-holes is desirable, the drilling is also controlled by gyroscopes, which, together with the laser beams, determine the direction of drilling and the angle of rotation of the long drill-holes within the layer 9, as well as determine composition of rock material and temperatures, pressures and other characteristics within in-situ space by analyzing the measured data via computer processors positioned at the surface.

Lengths of the drill-holes 5 and 6 may vary depending on a distance between the drilled production wells 1 from and may be in the range from less than about 20 meters to more than about 200 meters. Distances between axes of the long drill-holes with small diameters may vary depending on permeability of rock material within the layers, rate of filtration of oil and gas therefrom, and oil viscosity, and may be in the range from less than about 5 meters to more than about 50 meters.

The rock dust displaced from the bottom-holes of the long drill-holes 5 and 6 by drilling is completely evaporated via the high-power laser beams, and the light energy emitters are protected from penetration by water, oil and fine rock particles via lenses made with high strength transparent materials, such as, for example, sapphire lenses, made of artificial crystals. The lenses are also used to refocus the high-power laser beams to increase or reduce their influence based on varying strength of the rock and layer material and based on various modes of use, for example, during complete evaporation of rock dust drilled from the wells and drill-holes, or during depositing of melted mixtures of drilled out material and artificial substances injected into the wells from the surface or melting the layers of suitable rock material.

It is desirable to drill many closely-spaced long drill-holes with small diameters via the laser units in the production wells drilled in impenetrable oil and gas layers with high-viscosity oil, as well as in shale layers for extraction of shale oil and shale gas. In order to extract shale gas from the shale layers, the drill-holes with small diameters are drilled from the production wells located in the shale layers to maximum lengths possible under particular conditions, with optimal distances between the drill-holes based on sizes of closed cavities containing shale gas within the layers. This way, during the drilling by power, outstretch and falling of the layers, the long drill-holes will be introduced into a maximum number of closed cavities containing shale gas, allowing for inflow of gas from these cavities into the production wells. In the layers containing kerogens, from which shale oil may be extracted under increased temperatures in in-situ spaces, in order to extract shale oil a large number of drill-holes is drilled from the production wells positioned at an optimal distance from each other, and diameters of the drill-holes are increased to maximum values possible under given conditions, while lengths of the drill-holes and distances between the axes of the drill-holes are decreased to obtain maximum efficiency, and a plurality of emitters of high-power light energy are introduced into the drill-holes via the optical fiber cables. After in-situ temperatures are thus increased to 500-550 degrees Celsius, shale oil is formed out of kerogens, and the formed oil flows from the layers into the production well under the influence of simultaneous pressure increase.

Most mountain rocks and layers begin evaporating under the influence of high-power laser beams under the temperature of more than about 750 degrees Celsius, and in some cases, even under lower temperatures, such as, for example, carbonate rocks. As a result, large cracks, channels and cavities are formed in such rocks. Under temperatures of more than about 950 degrees Celsius, all minerals start evaporating with water, carbon-dioxide gas, sulfur dioxide and other gas emissions, and under temperatures of more than about 1450 degrees, silicon oxide mixed with other gas impurities starts evaporating from rocks, and under temperatures of more than about 1750 degrees, methane and ammonia begin evaporating from rocks and layers. With further temperature increase, the majority of rock material will turn into gases.

As illustrated in FIGS. 1A and 1B, the long drill-holes with small diameters 5 drilled along the plane of the layer 9 and the long drill-holes 6 drilled through the thickness of the layer 9 are positioned at optimal distance from each other within in-situ space, and this arrangement allows for the most complete and efficient extraction of oil and gas from the layer 9, with the predetermined permeability of the layer and recoverable reserves of mineral resources contained within the layer. If certain properties and characteristics of the layer 9 change during the treatment of the layer, the positioning and characteristics of the long drill-holes with small diameters 5 and 6 may also be adjusted by increasing or decreasing the distance between the drill-holes and by changing their lengths and diameters, as well as by increasing in-situ temperature and pressure, to maintain the target level of oil and gas extraction. Because the production wells 1 and the long drill-holes with small diameters 5 and 6, drilled by power and outstretch of the layer 9, evenly cover large areas within the layer 9, it is possible to extract even non-commercial oil and gas reserves that were not taken into account while calculating recoverable reserves as an object for potential extraction, due to cross-flows through the systems of cracks and channels in the areas of intensive extraction.

Figure 2:
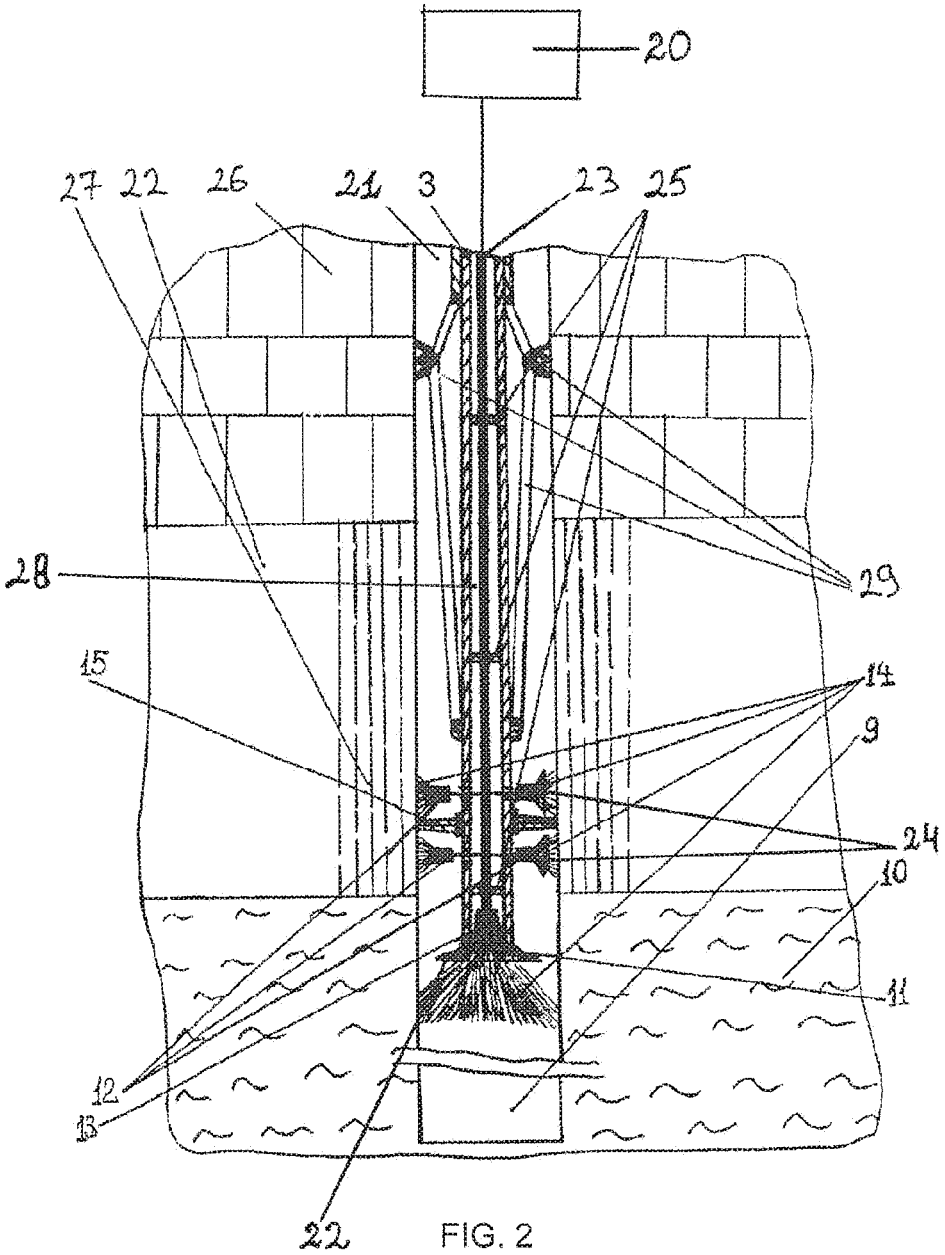

FIG. 2 illustrates a vertical cross-section of the rock mass with an more detailed exemplary embodiment of the laser-mechanical drilling system 3 of the present invention positioned in a vertical production well for drilling of a well and subsequent enlargement of the well diameter by gradual removal or cutting off layers of given thickness along all the thickness of oil and gas layer. In this embodiment, the flexible drilling rods 4 coupled to the drilling system 3 are not shown for ease of illustration.

The vertical production well 21 is drilled at the new development site from the surface towards the oil and gas layer 22 via the laser-mechanical drilling system 3 of the invention. The drilling is implemented by using light energy emitters and the optical fiber cable 23, which includes a plurality of optical fibers (light guides) that transmit light energy without losses from the high-power laser equipment positioned at the surface to the light energy emitters positioned within the wells. The emitters are positioned in an internal lumen 28 of the laser-mechanical drilling equipment 3 having hollow actuating rods and positioning devices or fixators 25 that prevent the optical fiber cable 23 from curling. The mountain rock layer 26 is destroyed and evaporated and the gas and oil layer 22 and its bottom 10 is treated with high-power high-temperature laser energy 14 emitted from a central emitter 13 positioned at a distal end of a central drilling crown 11 and from secondary extendible lateral emitters 12. The central drilling crown 11 and lateral drilling crowns coupled to the expandable well-expanding device 29 are used to completely destroy the rock material to achieve the necessary diameter of the well 21.

A controller 20 is coupled to the central emitter 13 and the at least one lateral emitter 12, wherein the controller controls at least one characteristic of the laser beam emitted by the emitters 12 and 13. The characteristics controlled by the controller 20 include laser beam direction, laser beam intensity, time duration of laser beam emission, laser beam temperature, laser beam diameter, width and length, and laser beam focus. These characteristics are controlled based on a composition of rock material surrounding the well, as well as size and shape of formation layers, and other parameters. The direction of the laser beam emitted by the emitters 12 and 13 may be changed by reflecting the laser beam via a reflecting mirror or a prism.

During the drilling of the vertical production well 21, the well walls are reinforced to prevent them from collapsing by either simultaneously melting the well wall material, if it is suitable for this purpose, via high-power light emission 14 from the lateral emitters 12, or by depositing one or more layers on the well walls, wherein the layers are made of mixtures of substances prepared at the surface and remaining rock dust drilled from the bottom-hole of the well, or by completely evaporating the rock dust drilled from the bottom-hole of the well via the high-power laser emission 14 and then depositing layers of mixtures prepared at the surface onto the well walls 21.

In certain circumstances, it is necessary to deposit layers made with artificially prepared mixtures of substances on the well walls 21 in order to reinforce them because not all mountain rock material can be melted during the drilling of the well 21 and not under all conditions. For example, carbonate rocks and certain other types of rock material are very difficult or even impossible to melt due to fast destruction and evaporation of mixed-in weak minerals, such as calcite, dolomite, marlstone, chalk-stone and others, that quickly evaporate under high-power light influence and thus, cavities and cracks can be formed within the walls of the well. In such cases, the power of laser emission may be regulated via the controller 20 coupled to the lateral emitters 12 by refocusing of transparent protective lenses 22 and 24, for example, sapphire lenses made of artificial crystals, that are positioned over the emitters 12 to reduce (by increasing divergence) or increase intensity of light emission based on changes in strength characteristics of the rock and layer material, or based on changes in the mode of operation, such as during depositing of various melted mixtures onto the well wall to reinforce them, or melting of the layers of suitable rock material, or complete evaporation of rock and layer material.

In case of formation of water inflows or areas of weakened mountain rocks, for example carbonate rocks, with formation of cavities and cracks after the treatment with high-power laser beams, the well walls are reinforced by depositing a plurality of layers made from melted rock dust drilled out of the bottom-holes of the wells and left over after evaporation, wherein the rock dust is extracted out of the bottom-holes by compressed air and deposited onto circular welding devices 15 equipped with emitters of laser energy. The rock dust is combined with mixtures of quartz sand with other necessary substances, such as, for example, lead oxide, and materials for glasifying these materials within wells and depositing them on the well walls. In other embodiments, the rock dust drilled from the bottom-holes of the wells is completely evaporated and mixtures of substances prepared at the surface are supplied to the wells to be melted and deposited on the well walls for their reinforcement. All of the above mixtures are melted and deposited via the circular welding devices 15 on the well walls or on the melted rock and layer material within the wells with changing diameter and the emitters of high-power light energy located therein with the use of lateral laser energy emitters 12 positioned at a specified distance from the central crown of the laser-mechanical drilling system, with the capability of radial movement and full-circle rotation, either separately or together with the hollow actuating drilling rods.

Whenever needed, the method of the invention may be used to carry out continuous or major repairs of the well 21 by using the expandable well-expanding device 29 with the lateral crowns in order to achieve a desired diameter of the well via the laser-mechanical drilling system. The waste material created after the repairs, together with collapsed rock particles and pieces of destroyed layers deposited on the well walls, get into a bottom of the well 21, which primarily functions to collect miscellaneous waste material from the well and in some cases, to facilitate advancement of the drilling equipment below the bottom of the layer 22. After the well 21 is created, its walls are polished to a desired depth by depositing artificially created layers on the walls to create smooth wall surfaces and uniform diameter along the entire well 21, except the region where a thick oil and gas layer 22 is opened. At this region of the oil and gas layer 22 opened by the vertical production well 21 the diameter of the well 21 is gradually increased along the thickness of the layer 22 to a specified value via the laser-mechanical drilling system of the invention with the expandable well-expanding device 29 with the lateral crowns. In order to do that, the layers made with mixtures deposited onto the well walls for reinforcement during the drilling are cut off by gradually moving the drilling equipment up and down along the well. During the exploitation of the production well, its diameter is increased repeatedly and multiple subsequent layers 27 of specified thickness are cut off the well walls within the layer 22 by the laser-mechanical equipment of the present invention, together with asphalt, tar and paraffin deposits accumulated on the walls during the exploitation period, thereby improving the infiltration of oil and gas out of the layer into the well and also increasing the inflow area. The well diameter is increased to maximum value suitable under particular conditions for a particular layer type and taking into account capabilities of the laser-mechanical drilling system. At the same time, the area of inflow of oil and gas from the layer 22 to the well 21 is maximized, as well as the amount of oil and gas extracted out of the layer. After a prolonged time period of exploitation of the production well 21, which leads to inevitable decrease in well's productivity, multiple long drill-holes with small diameters are drilled throughout the entire layer 6 thickness in directions towards other long drill-holes drilled from the adjacent production wells located within the same layer 22 to again improve oil and gas inflow into the well by significantly increasing the inflow area out of the layer, thus resulting in virtually complete extraction of oil and gas out of the layer and thereby reducing the time needed for effective exploitation of the layer.

Currently, the methods used to develop oil and gas and shale fields are not suitable for drilling many long drill-holes with small diameters from the production wells into the layers and rocks to evenly cover large areas within in-situ spaces in order to create conditions suitable for most efficient and complete extraction of oil and gas from the layers. Hydraulic fracturing technologies, which are currently utilized to extract oil and gas from the layers, are only capable of creating a few cracks (a single hydraulic fracturing cycle creates a single crack with an opening of few millimeters) that propagate in directions within the in-situ spaces that cannot be controlled, wherein those hydraulic fracturing cracks are quickly compressed by mountain rock pressure, despite pumping of expansion materials therein, such as quartz sand, small rocks, and other substances, which leads to significant reduction or elimination of oil and gas inflow out of the layers. This is especially true in cases wherein layer waters break into the production wells due to unexpected and occasional cracks forming through the water-bearing layers. For shale layers, large amounts of chemical components are typically added to liquids pumped into the wells during repeated hydraulic fracturing of the layers to improve efficiency thereof, and those substances and agents cause pollution of the environment around the formation layers. These known technologies cannot guarantee good efficiency and a high degree of oil and gas extraction from the production fields, and at the same time, cause significant harm to the environment.

The system and method of the present invention is ecologically clean compared to the known technologies that pollute and poison territories surrounding the field with agents and substances used during the oil and gas production process, as well as with miscellaneous production wastes and mud spills out of outdated wells that had not been worked out fully, as well as remaining oil and gas being vented into the atmosphere, such as methane that contributes into the greenhouse effect. The method of the present invention also allows for full and highly efficient extraction of oil and gas out of the production fields to gain valuable profit when implemented both at new undeveloped fields and fields that have been in operation for a long time. The method of the invention further allows for efficient elimination of underground disposals of harmful radioactive and chemical substances via evaporation of these substances underground via high-power laser beams. This method also allows for melting into the underground workings out of the ore bodies, lenses and veins, various metals contained therein, such as iron, copper, nickel, aluminum, silver, gold, platinum, and others.

Figure 3:
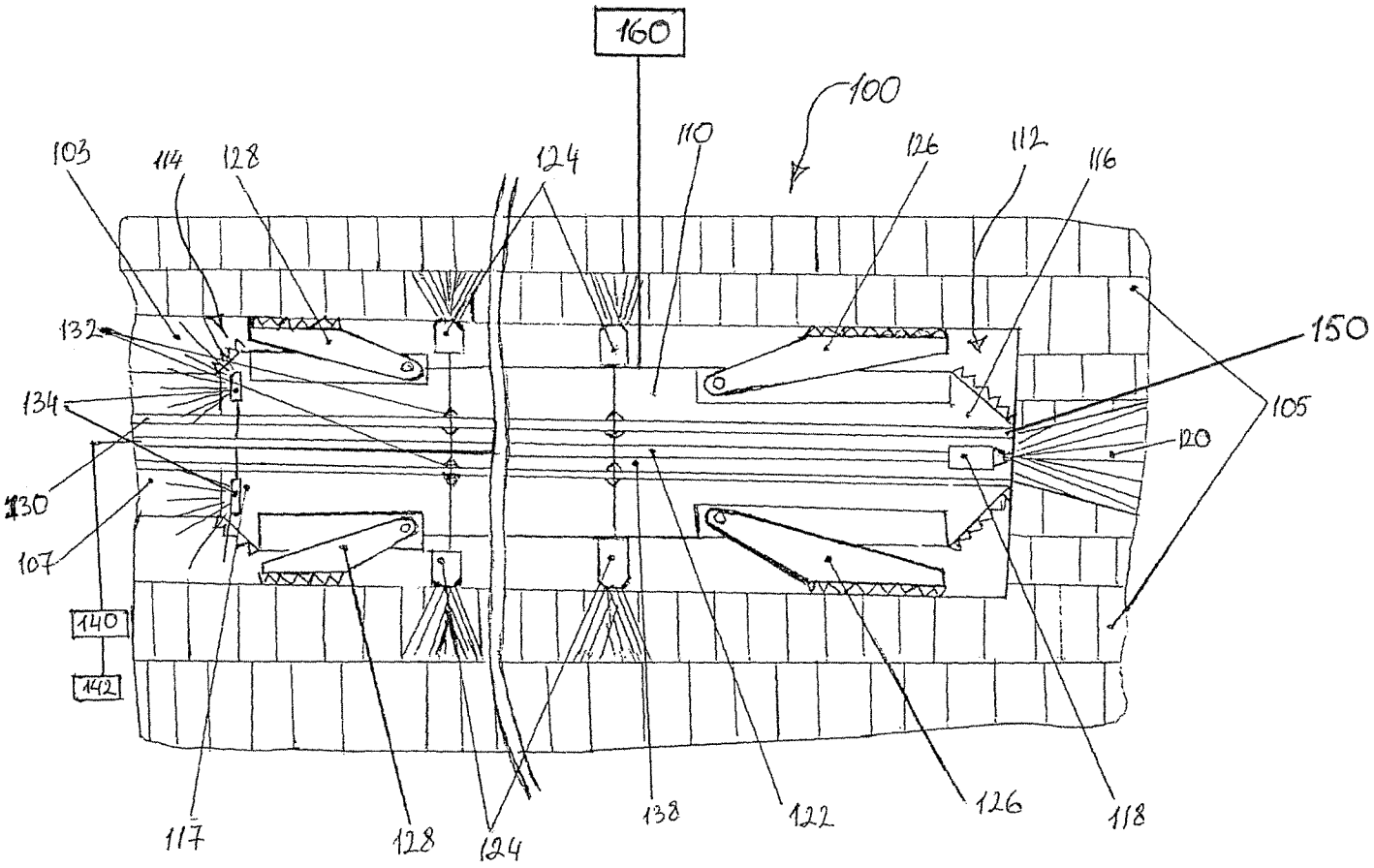

FIG. 3 is a more detailed illustration of an exemplary embodiment of a drilling rod of the system for extracting oil and gas shown in FIGS. 1A and 1B. The drilling rod 100 can be used with the laser mechanical system shown in FIG. 2. Alternatively, the drilling rod 100 is used in an existing well produced by any type of drilling equipment, such as, e.g., convention mechanical drilling system. The drilling rod 100 is particularly suitable for extracting gaseous hydrocarbons from oil and gas formations.

The drilling rod 100 is shown as being positioned in a drill-hole 103 (also shown as 6 in FIGS. 1A and 1B), which is drilled outward from the main production well designated as 1 in FIGS. 1A and 1B. Once the main production well 1 is created via the laser-mechanical system shown in FIG. 2 or any other known drilling system, the drilling rod 100 is introduced into the well 1 via a coiled tubing, a pumping pipe, or via any other suitable device. Once the drilling rod 100 is positioned at a desired location within the well 100, the drilling rod is actuated to create an elongated drill-hole 103 (or 5 and 6 in FIGS. 1A and 1B) out of the well and into surrounding oil and/or gas layers 105.

The drilling rod 100 includes an elongated body 107 with a working head 110 positioned at a distal end of the elongated body. The working head has a proximal end 114 and a distal end 112. The working head includes a first mechanical drilling device 116 positioned at the distal end 112 of the working head 110. The working head 110 further includes a second mechanical drilling device 117 positioned at the proximal end 114 of the working head. Any suitable mechanical drilling devices, such as drill bits, may be used in accordance with the present invention. The size and shape of the drilling devices 116 and 117 is chosen depending on conditions of a particular oil and/or gas development field.

The drilling rod 100 further includes a central laser emitter 118 positioned at the distal end 112 of the working head 100. The central laser emitter 118 may be positioned inside a central opening in the first drilling device 116, as shown in FIG. 3. In other embodiments, one or more central emitters may be positioned around the perimeter of the first drilling device 116.

There are also a plurality of lateral emitters 124 positioned on a side wall of the working head 110 between the distal end 112 and the proximal end 114. In the embodiment shown in FIG. 3, there are four lateral emitters 124 positioned on the working head 110. In other embodiments, less than four or more than four lateral emitters may be provided. The lateral emitters 124 may be positioned at any desired location on the side wall of the working head 110 between the distal and proximal ends of the working head.

The central emitter 118 and the lateral emitters 124 are coupled to a fiber optic cable 122 positioned within a lumen 138 of the elongated body 107 of the working head 110. At its proximal end, the fiber optic cable 122 is coupled to a laser source 140, which may be positioned on the surface outside of the well, or in some cases may be positioned somewhere inside the well. Any suitable type of the laser source, such as described above, may be used. The laser source supplies a laser beam to the central emitter 118 and the lateral emitters 124 to melt down and/or evaporate rock material to create the drill-hole 103. The lumen 138 may include one or more fixators 132 that receive the fiber optic cable 122 to prevent it from coiling. Any desired number of fixators 132 may be positioned inside the lumen 138 along the length of the elongated body of the drilling rod.

The system further includes a controller 142 coupled to at least one of the central emitter 118 and the lateral emitters 124. The controller 142 controls at least one characteristic of the laser beam, including laser beam direction, laser beam intensity, time duration of laser beam emission, laser beam temperature, laser beam diameter, laser beam length, and laser beam focus. The controller receives various data via the fiber optic cable that is used to control the characteristics of the laser beam. The data includes information about laser beam reflected from surrounding surfaces, composition of surrounding rock material, size of openings in formation layers after evaporation via the laser beams, and other information about the formation containing hydrocarbons.

The drilling rod 100 also includes one or more rear emitters 134 positioned at the proximal end 114 of the working head 110 adjacent the second mechanical drilling device 117. In the exemplary embodiment shown in FIG. 3, two or more emitters 134 are positioned around the perimeter of the second mechanical drilling device 117. It is understood, however, that other configurations of the rear emitters may be used. The rear emitter 134 is also coupled to and receives laser beams from the optical cable 122 and is also coupled to the controller 142 that controls the laser beams emitted by the emitter 134.

The central emitter 118, lateral emitters 124 and/or the additional lateral emitter 134 may be covered with protective lens to protect the emitters from elements present during drilling process. In some embodiments, the lens are made with artificially grown crystals. Any other suitable lens material may also be used that withstands aggressive environment conditions, such as high temperatures and/or pressures, and transmits laser beams.

The working head 110 of the drilling rod 100 further includes an expanding member 126 coupled to the working head adjacent its distal end 112. The expanding member has two or more drilling crowns coupled thereto. The drilling crowns 126 are actuated via a suitable mechanical, pneumatic or electrical actuation device such that the drilling crowns move outwards from the working head and come into contact with surrounding rock material, as shown in FIG. 3. The drilling crowns 126 are positioned such that they displace surrounding rock material as the drilling rod 100 with the first drilling device is moves forward into the drill-hole. The expanding member with the drilling crowns 126 is used to enlarge an inner diameter of the drill-hole as necessary. In some embodiments, the drill crowns 126 may be actuated separately to cause the drilling rod 100 to change direction in its forward movement such that the drill-hole may be angled if necessary. It is contemplated though that in some embodiments, a suitable separate steering mechanism 160 is coupled to the working head 110 to change the direction in which the working head travels.

An additional expanding member 128 may also be provided coupled to the working head 110 adjacent its proximal end 114. The additional expanding member also includes two or more expanding drilling crowns 128 that are actuated via any suitable mechanism. The drill crowns 128 are expanded such that they come into contact with surrounding rock material and displace the material as the drilling rod 100 is withdrawn from the drill-hole 103. This may be particularly advantageous in a situation where material drilled out of the drill-hole during the forward movement of the drilling rod blocks the exits of the drilling rod from the drill-hole. Additionally, walls of the drill-hole may collapse after drilling, which may also impede the withdrawal of the drilling rod from the drill-hole. The rear expanding member with the drilling crowns 128 displaces the material blocking the way such that the drilling rod 100 can be successfully removed from the drill-hole. Furthermore, the working head 110 may be moved back and forth within the drill-hole such that both the front and rear expanding members 126 and 128 displace rock material from the walls of the drill-hole to enlarge the inner diameter of the drill-hole. The rear expanding member with the drilling crowns 128 can also be used to change the direction of the working head 110, as discussed above.

The working head 110 of the drilling rod 100 is coupled to a motor that actuates a rotational movement of the working head 110. The motor is positioned downhole and is coupled to an electric cable, which is in turn coupled to an electric power source positioned either on the surface outside of the well or at some place within the well. The electric cable may be held in place by the fixators 132 to prevent it from coiling. It is noted that any other suitable type of a motor, such as hydraulic or pneumatic motor, may be used instead. The advantage of using the downhole motor as opposed to rotating the working head via a mechanism provided at the surface outside of the well is that it provides for a more efficient rotation actuation of the working head that requires less power.

The rotation of the working head 110 also causes rotation of the first and second drilling devices 116 and 117, as well as the rotation of the front and rear emitters 118 and 134, and the lateral emitters 124, to melt down and/or evaporate and break down surrounding rock material. The rotation of the working head 110 also causes rotation of the front and rear expanding members 126 and 128 and if they are in the expanded position, the drilling crowns of the expanding members break down and displace the surrounding rock material.

It is also contemplated that the first and second drilling devices 116 and 117 may be rotationally actuated separately from the working head 110 and/or from each other to perform drilling and displacement of the rock material. Similarly, the front and rear expansion members 126 and 128 may be actuated separately from each other and/or from other components of the drilling rod 100.

In some embodiments, the drilling rod 100 also includes a fluid supply lumen 130 positioned in the inner lumen 138 of the elongated body of the drilling rod and an outlet 150 positioned at the distal end 112 of the working head 110 and coupled to the fluid supply lumen 138. The fluid supply lumen may be encased in a flexible fiberglass tube or any other suitable encasing. The fluid supply lumen 130 is coupled to a source of fluid positioned on the surface outside of the well and is used to supply a desired fluid or gas to the drill-hole 103 to cool down the rock material after it is being exposed to the laser beams emitted from the working head 110.

When in use, the drilling rod 110 is inserted into the existing well via a coiled tubing or other suitable mechanism. Once the drilling head is positioned at a desired location within the well, the forward central emitter 118 is actuated to emit laser beams to weaken, melt and/or evaporate rock material of the well wall to create an opening in the wall and to create an elongated drill-hole 103 extending away from the well into the oil and/or gas containing formation layer 105. The weakened rock material is then displaced by the rotating first drilling device 116 to elongate the drill-hole and to enlarge its diameter as necessary.

In some embodiments, the central emitter 118 is extendable relative the distal end 112 of the working head 110. The central emitter 118 is first extended out of the opening in the working head 110 such that it is positioned ahead of the drilling rod 100 and the rock material ahead of the working head 110 is impacted by laser beams emitted from the central emitter 118.

The length of the drill-hole 103 is extended by moving the drilling rod 100 further into the drill-hole while continuing to impact the rock material via the laser beam from the central emitter 118 with subsequent drilling of the weakened rock material by the first drilling device 116. As described above, the diameter of the drill-hole 103 can also be enlarged via impacting the rock material with laser beams emitted from the rear central emitter 134 and displacing the weakened rock material via the second drilling device 117 positioned at the proximal end 114 of the working head 110.

The inner diameter of the drill-hole is then enlarged further by impacting surrounding material with laser beams emitted from the lateral emitters 124 positioned on the side wall of the working head 110. The drill-hole diameter can also be mechanically enlarged by displacing surrounding rock material via the front expanding member 126 and/or the rear expanding member 128, as described above.

An angle between a longitudinal axis of the drill-hole 103 and a longitudinal axis of the existing well may be adjusted as necessary by changing a direction of the laser beams emitted from the central emitter 118 and/or the lateral emitters 124. The direction of the laser beams emitted from the central emitter 118 may be changed by articulating the working head 110 of the drilling rod. The angle between the longitudinal axis of the drill-hole and the longitudinal axis of the well can also be changed by changing a position of the drilling crowns of the expanding members 126 and 128.

Once the gaseous hydrocarbons within the formation layers are exposed to extremely high temperatures of the laser beams, they break down into water and natural gas, such as methane. These water and gas byproducts are then removed from the drill-holes and the well via a fluid return lumen provided in the inner lumen 138 of the drilling rod 100. A pump may be coupled to the fluid return lumen to facilitate more efficient removal of the byproducts from the drill-holes and wells. The removal of water and gas byproducts creates depressions and lowers pressure within the formation layers. This in turn speeds up and facilitates more efficient break down of the gaseous hydrocarbons into their byproducts, which leads to more effective and complete extraction of oil and gas from formation layers.

As illustrated in FIGS. 1A and 1B, additional drill-holes may be formed in adjacent wells by the same drilling rods positioned in those well, such that the drill-holes 5 and 6 from the neighboring wells intersect each other or extend adjacent each other. The temperature and mechanical stress caused by the laser-mechanical drilling in accordance with the present invention causes formation of numerous cracks in the formation rock material from the neighboring drill-holes. All of this increases the inflow of oil and gas and gaseous byproducts from the formation layers onto the drill-holes and the wells, leading to a more efficient extraction.

Diameters of the elongated drill-holes 5 and 6 are enlarged to a desired size by moving the drilling rods backward out of the drill-holes by impacting surround rock material by laser beams emitted from the rear central emitter 134 positioned at the proximal end 114 of the working head 110 and then impacting the weakened rock material by the second mechanical drilling device 117. The diameter of the drill-holes is further enlarged by gradually expanding the rear expanding device 128 such that its drilling crowns displace the rock material from the drill-hole walls. The working heads of the drilling rods can also be displaced back and forth within the drill-holes, which together with the gradual expansion of the front and rear expansion devices displaces the rock materials from the drill-hole walls and enlarges the diameter of the drill-hole.

If even a bigger diameter of the drill-holes is desired, the drilling rods may be withdrawn from the drill-holes and additional drilling rods with larger diameters may be positioned in the drill-holes to create larger diameter openings. The positioning of the additional drilling rods within the drill-holes may be facilitated by the controller 142 based on predetermined location coordinates programmed into the drilling system.

In some embodiments, the method of the present invention further includes supplying oxygen to the drill-hole 103 to initiate burn out of gaseous byproduct of the hydrocarbons that have been exposed to the high temperature of the laser beams, or oil and/or gas present in the formation layers. This significantly lowers the amount of energy needed for the laser-mechanical drilling in accordance with the invention. It also lowers viscosity of oil and increases internal temperature of the formation layers, which leads to much faster drilling process and increases the efficiency of oil and gas extraction as compared to known drilling methods.

After the extraction of oil, gas and gaseous byproducts, e.g. methane, is completed, fluid that has been previously withdrawn from the drill-holes and wells in case of on-shore drilling and ocean water in case of off-shore drilling may be mixed in with particular polymers and other chemical ingredients and pumped back into the wells and drill-holes. This chemical solution hardens and functions as a support structure in voids in the formation layers created by extraction of gaseous hydrocarbons. This prevents weakening and sagging of the ocean floor or icy rock formations onshore and improves environmental impact of the extraction process.

It should be understood that the foregoing is illustrative and not limiting, and that obvious modifications may be made by those skilled in the art without departing from the spirit of the invention. Accordingly, reference should be made primarily to the accompanying claims, rather than the foregoing specification, to determine the scope of the invention.

What is claimed is:

1. A system for extracting oil and gas, comprising:

at least one drilling rod having an elongated body and a working head positioned at a distal end of the elongated body, wherein the working head has a proximal end and a distal end;

a first mechanical drilling device positioned at the distal end of the working head;

a second mechanical drilling device positioned at the proximal end of the working head;

a central laser emitter positioned at the distal end of the working head;

at least one lateral emitter positioned on a side wall of the working head between the distal end and the proximal end;

a fiber optic cable positioned within a lumen of the elongated body and coupled to the central laser emitter and the at least one lateral emitter; and a laser source coupled to and supplying a laser beam to the fiber optic cable.

2. The system of claim 1, further comprising a controller coupled to at least one of the central emitter and the at least one lateral emitter, wherein said controller controls at least one characteristic of the laser beam.

3. The system of claim 2, wherein the at least one characteristic comprises at least one of laser beam direction, laser beam intensity, time duration of laser beam emission, laser beam temperature, laser beam diameter, laser beam length, and laser beam focus.

4. The system of claim 1, further comprising at least one lens positioned over the central emitter and the at least one lateral emitter.

5. The system of claim 1, further comprising one or more rear emitters positioned at the proximal end of the working head adjacent the second mechanical drilling device.

6. The system of claim 1, further comprising a motor coupled to the working head, wherein the motor actuates a rotational movement of the working head.

7. The system of claim 1, further comprising an expanding member coupled to the working head adjacent its distal end, wherein the expanding member comprises two or more drilling crowns coupled thereto and an actuator that expands the expanding member such that the drilling crowns come into contact with surrounding rock material.

8. The system of claim 7, wherein the expanding member performs a forward movement to displace surrounding rock material as the drilling rod moves into a drill-hole.

9. The system of claim 8, further comprising an additional expanding member coupled to the working head adjacent its proximal end, wherein the additional expanding member comprises two or more drilling crowns coupled thereto and an actuator that expands the additional expanding member such that the drilling crowns come into contact with surrounding rock material, wherein the additional expanding member performs a backward movement to displace surrounding rock material as the drilling rod is withdrawn from the drill-hole.

10. The system of claim 9, wherein the drilling crowns of the expanding member and the additional expanding member perform a rotational movement to break down surrounding rock material.

11. The system of claim 1, further comprising at least one fixator positioned in the lumen of the elongated body, wherein the at least one fixator receives the at least one fiber optic cable to prevent it from coiling.

12. The system of claim 1, further comprising a fluid supply lumen positioned in the inner lumen of the elongated body and an outlet positioned at the distal end of the working head and coupled to the fluid supply lumen, wherein fluid is supplied through the fluid supply lumen and the outlet to cool down the surrounding rock material after it is impacted by the laser beam emitted from at least one of the central emitter and the at least one lateral emitter.

13. The system of claim 1, further comprising a steering mechanism coupled to the working head of the at least one drilling rod, wherein the steering mechanism changes a direction in which the working head travels.

14. A method of developing oil and gas fields, comprising the steps of:

inserting at least one drilling rod into an existing well, the at least one drilling rod having a working head with a distal end and a proximal end;

forming at least one elongated drill-hole from said well into surrounding material by impacting rock material via a laser beam emitted from an emitter positioned at the distal end of the working head; and extending a length of the at least one elongated drill-hole by moving the at least one drilling rod further into the elongated drill-hole while continuing to impact the rock material via the laser beam;

displacing the impacted rock material via a front drilling head positioned at the distal end of working head of the at least one drilling rod while moving the drilling rod into the elongated drill-hole; and displacing surrounding rock material via a rear drilling head positioned at the proximal end of the at least one drilling rod while withdrawing the drilling rod from the elongated drill-hole.

15. The method of claim 14, further comprising a step of adjusting an angle between a longitudinal axis of the at least one elongated drill-hole and a longitudinal axis of the existing well by changing a direction of the laser beams emitted from the emitter positioned on the at least one drilling rod.

16. The method of claim 15, wherein the direction of the laser beams emitted from the emitter is changed by articulating the distal end of the working head of the drilling rod.

17. The method of claim 14, wherein the emitter is extendable relative the distal end of the working head and the step of impacting rock material via the laser beam comprises extending the emitter past the distal end of the working rod.

18. A method of developing oil and gas fields, comprising the steps of:

inserting at least one drilling rod into an existing well, the at least one drilling rod having a working head with a distal end and a proximal end;

forming at least one elongated drill-hole from said well into surrounding material by impacting rock material via a laser beam emitted from an emitter positioned at the distal end of the working head;

extending a length of the at least one elongated drill-hole by moving the at least one drilling rod further into the elongated drill-hole while continuing to impact the rock material via the laser beam; and enlarging an inner diameter of the elongated drill-hole by displacing surrounding rock material via an expanding member coupled to the working head adjacent its distal end, wherein the expanding member comprises two or more drilling crowns coupled thereto and an actuator that expands the expanding member such that the drilling crowns come into contact with surrounding rock material and displace the rock as the at least one drilling rod is moved into the elongated drill-hole.

19. The method of claim 18, further comprising a step of adjusting an angle between a longitudinal axis of said at least one elongated drill-hole and a longitudinal axis of the well by changing a position of the drilling crowns of the expanding member.

20. The method of claim 18, further comprising a step of displacing rock material in the elongated drill-hole via an additional expanding member coupled to the working head adjacent its proximal end, wherein the expanding member comprises two or more drilling crowns coupled thereto and an actuator that expands the expanding member such that the drilling crowns come into contact with surrounding rock material and displace the rock as the at least one drilling rod is withdrawn from the elongated drill-hole.

21. The method of claim 14, further comprising a step of removing fluid byproducts of gaseous hydrocarbons from the at least one elongated drill-hole via a fluid return lumen provided in the at least one drilling rod.

22. The method of claim 14, further comprising a step of supplying oxygen to the at least one elongated drill-hole via a lumen of the at least one drilling rod to initiate burn out of at least one of a gaseous hydrocarbon byproduct, gas and oil.

23. The method of claim 14, further comprising a step of forming at least one additional-drill hole via an additional drilling rod placed in an adjacent well such that the two drill-holes intersect each other.

* * * * *